US011585249B2

(12) United States Patent
Hainzlmaier et al.

(10) Patent No.: US 11,585,249 B2
(45) Date of Patent: Feb. 21, 2023

(54) HEAT EXCHANGER SYSTEM

(71) Applicant: Webasto SE, Stockdorf (DE)

(72) Inventors: Christian Hainzlmaier, Stockdorf (DE); Marvin Lappe, Stockdorf (DE); Christoph Cap, Stockdorf (DE); Karl Göttl, Stockdorf (DE); Hans Rechberger, Stockdorf (DE); Tobias Hentrich, Stockdorf (DE); Jürgen Lipp, Stockdorf (DE)

(73) Assignee: WEBASTO SE, Stockdorf (DE)

( * ) Notice: Subject to any disclaimer, the term of this patent is extended or adjusted under 35 U.S.C. 154(b) by 1046 days.

(21) Appl. No.: 15/999,668

(22) PCT Filed: Feb. 13, 2017

(86) PCT No.: PCT/EP2017/053113

§ 371 (c)(1),
(2) Date: Aug. 20, 2018

(87) PCT Pub. No.: WO2017/140608

PCT Pub. Date: Aug. 24, 2017

(65) Prior Publication Data

US 2021/0207501 A1 Jul. 8, 2021

(30) Foreign Application Priority Data

Feb. 18, 2016 (DE) ..... 10 2016 102 893.2

(51) Int. Cl.
*F01M 5/00* (2006.01)
*H05B 3/12* (2006.01)
(Continued)

(52) U.S. Cl.
CPC ..... *F01M 5/001* (2013.01); *F01M 5/002* (2013.01); *H05B 3/12* (2013.01); *H05B 3/20* (2013.01);
(Continued)

(58) Field of Classification Search
CPC ..... F01M 5/001; F01M 5/002; H05B 3/20; H05B 3/12; H05B 2203/013; F28D 2021/0089
See application file for complete search history.

(56) References Cited

U.S. PATENT DOCUMENTS 5,017,758 A 5/1991 Kirkman et al.
5,352,862 A * 10/1994 Barr ..... F01M 5/021 123/142.5 R
(Continued)

FOREIGN PATENT DOCUMENTS

DE 19823245 C5 12/1999
DE 102013010907 A1 12/2014
(Continued)

OTHER PUBLICATIONS

English translation of PCT IPRP, Search Report and Written Opinion dated Jun. 6, 2018 in connection with PCT/EP2017/053113.
(Continued)

*Primary Examiner* — Shawntina T Fuqua
(74) *Attorney, Agent, or Firm* — Quarles & Brady LLP

(57) ABSTRACT

The invention relates to a heat exchanger system, in particular for connection to an internal combustion engine, preferably of a motor vehicle, comprising at least one heat exchanger module, in particular oil-water heat exchanger module (10), and a layer heating module (11), which is mounted or mountable on the heat exchanger module, wherein the layer heating module (11) comprises a substrate, in particular a carrier plate (12), and an electric heating coating (13) applied to the substrate, in particular to the carrier plate (12).

20 Claims, 1 Drawing Sheet

(51) Int. Cl.
*H05B 3/20* (2006.01)
*F28D 21/00* (2006.01)

(52) U.S. Cl.
CPC ..... *F28D 2021/0089* (2013.01); *H05B 2203/013* (2013.01)

(56) References Cited

U.S. PATENT DOCUMENTS

| | | | | |
|---|---|---|---|---|
| 9,151,542 | B2 * | 10/2015 | Otahal | F28D 9/005 |
| 9,375,993 | B2 * | 6/2016 | Bytzek | H05B 3/26 |
| 2001/0040025 | A1 * | 11/2001 | Jurisich | F28F 3/048 165/148 |
| 2008/0202735 | A1 * | 8/2008 | Geskes | F28F 9/0265 165/157 |
| 2015/0293065 | A1 * | 10/2015 | Kissell | G01M 5/0083 73/865.8 |

FOREIGN PATENT DOCUMENTS

| | | | | |
|---|---|---|---|---|
| EP | 0 961 012 | A1 | 12/1999 | |
| JP | S54177429 | U | 12/1979 | |
| JP | H01-74322 | U | 5/1989 | |
| JP | 2007016857 | A1 | 1/2007 | |
| JP | 2010113803 | A | 5/2010 | |
| JP | 2012154579 | A | 8/2012 | |
| JP | 2012216345 | A | 11/2012 | |
| JP | 5952529 | B2 * | 7/2016 | F01M 5/002 |
| WO | 2013 030048 | A1 | 3/2013 | |
| WO | 2013171079 | A1 | 11/2013 | |

OTHER PUBLICATIONS

Office Action dated Oct. 18, 2016 in connection with German Application 10 2016 102 893.2.
China National Intellectual Property Office. First Office Action for application 201780011969.0, dated Aug. 26, 2020. With machine translation.
Japan Patent Office, Notification of Reasons for Refusal, Application No. 2018-542163, dated Jul. 11, 2019, 8 pages.
Korean Intellectual Property Office, Office Action, Application No. 10-2018-7026346, dated Oct. 16, 2019, 22 pages.
European Patent Office. Office action for application 17705829.4, dated Nov. 11, 2020. With translation.
Japan Patent Office. Office Action for application 2020-126114, dated Sep. 29, 2021. With translation.
Deutsches Patent Und Markenamt. Office Action for application 10 2016 10 893.2, dated Nov. 25, 2021. With translation.
Japan Patent Office, Decision of Refusal, Application No. 2020-126114, dated May 6, 2022, 5 pages.

* cited by examiner

HEAT EXCHANGER SYSTEM

CROSS-REFERENCE TO RELATED APPLICATIONS

This application represents the national stage entry of PCT International Application No. PCT/EP2017/053111 filed on Feb. 13, 2017, and claims priority to German Patent Application No. 10 2016 102 890.8 filed on Feb. 18, 2016. The contents of these applications are hereby incorporated by reference as if set forth in their entirety herein.

The invention relates to a heat exchanger system, in particular oil-water heat exchanger system, in particular for connection to an internal combustion engine, preferably of a motor vehicle, according to claim 1, and to a method for producing a heat exchanger system of said type.

For example, EP 2 466 241 A1 describes an oil-water heat exchanger having multiple trough elements stacked one on top of the other and soldered to one another. Such oil-water heat exchangers are commonly integrated into the cooling circuit of internal combustion engines and may be used for example for cooling the engine oil.

A further oil-water heat exchanger is presented in US 2015/0176913 A1. In a particular embodiment, said document proposes an electric heater in an interior space of the heat exchanger for the purposes of warming one of the fluids that interact with one another in the heat exchanger.

In the case of the known oil-water heat exchangers, it is basically perceived to be disadvantageous that, in these, preheating is either not possible at all, or is possible only with relatively great outlay and in an ineffective manner (in particular slowly). In particular, the reduction of pollutants that form when the engine oil is not at operating temperature is considered to be in need of improvement.

With regard to the prior art, reference is basically also made to WO 2013/186106 A1 and WO 2013/030048 A1. Said documents describe heaters which have an electric heating layer which warms when an electrical voltage is applied (or when a current flows).

With regard to the prior art, reference is also made to DE 10 2011 006 248 A1. Said document describes a household refrigeration appliance with a heating device. The heating device is produced as a layer heater by lacquering and is applied to a surface of an evaporator of the household refrigeration appliance. Specifically, the layer heater in DE 10 2011 006 248 A1 is applied areally directly to a surface of the evaporator and exhibits scarcely any thermally insulating action, so as to have only the least possible detrimental effect on the functionality of the evaporator. It is however considered to be disadvantageous that, according to said prior art, the production process is relatively cumbersome and appears to be tailored to a highly specific usage situation.

It is therefore an object of the invention to propose a heat exchanger system in the case of which warming of at least one fluid flowing in a heat exchanger is possible in a simple and nevertheless effective manner.

Said object is achieved by means of a heat exchanger system having the features of claim 1.

In particular, the object is achieved by means of a heat exchanger system, preferably for connection to an internal combustion engine, comprising a heat exchanger module, in particular oil-water heat exchanger module, and a layer heating module, which is mounted or mountable on the heat exchanger module, wherein the layer heating module comprises a substrate, in particular a carrier plate, and a heating coating applied to the substrate, in particular to the carrier plate.

A core concept of the invention lies in the provision of a layer heating module, comprising a substrate and a heating coating, for connection to a heat exchanger module, in particular oil-water heat exchanger module. In a departure from the prior art, the heating coating is thus applied not directly to the heat exchanger but to a separate substrate, which in turn is mounted on (fastened to) the heat exchanger (heat exchanger module). Here, the advantages described in the prior art are indeed intentionally (at least partially) omitted in favour of simple and extremely variable (flexible) production. In particular, it can be stated that, through the provision of the substrate, the overall structural space of the heat exchanger system is initially enlarged. The transmission of heat is basically also less effective. Nevertheless, the invention has pursued the path of providing a (separate) layer heating module for permitting, in an effective manner and using simple means, warming of at least one fluid flowing in a heat exchanger. In particular, upgrading of existing heat exchangers (indeed of different types and/or different sizes) is possible in a simple manner, optionally by means of one and the same layer heating module.

The substrate is preferably a plate-like substrate, in particular a carrier plate. The plate preferably has two (at least substantially) planar surfaces. Unevennesses preferably have a maximum height of 5 mm, preferably 2 mm, even more preferably 0.5 mm. The substrate, in particular the carrier plate, may have a polygonal, in particular tetragonal, preferably rectangular outline, or a (circular) round or elliptical or irregularly shaped outline. A thickness of the substrate, in particular of the carrier plate, amounts to preferably at least 0.5 mm, preferably at least 1 mm, even more preferably at least 2 mm and/or at most 20 mm, preferably at most 12 mm, even more preferably at most 8 mm.

The layer heating module is preferably connected in material-locking fashion to the heat exchanger module, in particular adhesively bonded to the heat exchanger module and/or connected, in particular clamped, in non-positively locking and/or positively locking fashion to the heat exchanger module. In this way, a reliably functioning heat exchanger system is produced in a simple manner. Alternatively, the layer heating module may also be connected in some other way to the heat exchanger module, for example by mechanical fastening means (for example screws and/or bolts). Detent connection may alternatively or additionally also be provided, for example such that the layer heating module snaps into detent devices of the heat exchanger module.

The substrate, in particular the carrier plate, is preferably manufactured at least partially from a (thermally and/or electrically) insulating material. A thermally insulating material is to be understood in particular to mean a material with a coefficient of thermal conductivity (at 25° C.) of lower than 10 W/mK or lower than 2 W/mK or lower than 0.8 W/mK or lower than 0.5 W/mK. An electrically insulating material is to be understood in particular to mean a material with a specific resistance (at 25° C.) of at least $10^5$ $\Omega\cdot mm^2\cdot m^{-1}$ or at least $10^9$ $\Omega\cdot mm^2\cdot m^{-1}$ 2 W/mK or at least $10^{12}$ $\Omega\cdot mm^2\cdot m^{-1}$. The substrate, in particular the carrier plate, may in particular be manufactured from a (possibly insulating) ceramic. It is alternatively also conceivable for the substrate, in particular the carrier plate, to be manufactured from a conductor, for example metal. Then, if appropriate, an insulating layer may be provided between the heating coating and the substrate, in particular the carrier plate. It is however particularly preferable in general if the electric heating coating is applied directly to the substrate, in particular the carrier plate. In particular if the substrate, preferably the carrier plate, is manufactured from an insulating material, it is possible in a synergistic manner for the substrate to serve simultaneously as a carrier for the auxiliary module and as a structure which permits insulation, at least in sections, of the electric heating coating with respect to the heat exchanger module.

The heating coating and/or insulation layer is preferably applied to the substrate over the (full) surface. The heating coating and/or the insulation layer may furthermore have an (at least substantially) constant layer thickness. The heating coating or the insulation layer may be applied directly to the substrate. The heating coating and/or the insulation layer may be inherently of dimensionally unstable (or non-self-supporting) design.

In a specific embodiment, the heating coating is arranged on that side of the substrate, in particular of the carrier plate, which faces towards the heat exchanger module. In the case of such an embodiment, the heat exchanger module can be preheated in an effective manner.

Preferably, in the mounted state of the layer heating module, an intermediate space is formed at least in sections between layer heating module and heat exchanger module. The intermediate space is preferably filled (at least in sections) with a filler material ("gap filler"), in particular with a possibly compressible and/or elastically and/or plastically deformable foil. The foil preferably exhibits (good) thermal conductivity and furthermore preferably has a coefficient of thermal conductivity (at 25° C.) of at least 15 W/mK or at least 50 W/mK or at least 100 W/mK or at least 180 W/mK. In particular if the heating coating is arranged on that side of the substrate, in particular of the carrier plate, which faces toward the heat exchanger module, it is thus possible to realize simple insulation (at least in sections) of the heating coating with respect to the heat exchanger module. It is however basically also possible (in the mounted state) for the heating coating to be in contact (possibly over the full surface) with a surface of the heat exchanger module. In such a case, an insulating layer or an insulating cover may possibly be arranged on the heating coating (specifically on that side of the heating coating which points away from the substrate, in particular from the carrier plate). The heat exchanger module may however possibly also have a corresponding insulation layer or generally an insulating surface.

In a preferred embodiment, a contacting of the heating coating extends through the substrate, in particular the carrier plate. The contacting may furthermore preferably extend at least twice through the substrate, preferably such that one conductor section of the contacting extends parallel to the heating coating (so as to make contact therewith). In such embodiments, a simple and nevertheless reliable contacting is made possible, which at the same time saves space.

In one embodiment, the heating coating is earthed by means of the heat exchanger, module, in particular a housing of the heat exchanger module. Specifically, for this purpose, an earth contact (pad) or a spring or the like may be formed between heating coating and heat exchanger module. If the heating coating is arranged on that side of the substrate, in particular of the carrier plate, which faces toward the heat exchanger module, an earth line may also lead through the substrate, in particular the carrier plate, and then be earthed either externally (that is to say not via the heat exchanger module) or via the heat exchanger module. Altogether, a relatively straightforward closing of the current circuit is made possible.

In a preferred embodiment, both sides of the substrate, in particular of the carrier plate, are provided with a heating coating. Particularly effective heating is thus possible.

In further embodiments, at least two heat exchanger modules and/or at least two layer heating modules are provided. Preferably, at least one layer heating module is arranged between two heat exchanger modules. It is also possible for at least one heat exchanger module to be arranged between two layer heating modules. It is basically possible for multiple, for example at least two, or at least three layer heating modules to be arranged on one heat exchanger module. Altogether, in this way, it is possible for an effective exchange of heat, and warming of at least one of the fluids, to be realized in a flexible manner.

Preferably, the layer heating module is designed for operation in the low-volt range (preferably less than 100 V, and more preferably less than 60 V (direct current), preferably 12 volts, 24 volts or 48 volts). Electrical and/or electronic components required for the operation of the layer heating module can be designed accordingly. In this way, an insulation that is possibly required can be of relatively simple form. In particular, cumbersome insulators such as are common in the prior art (in the case of which the high-voltage range is used) are not necessary.

The above-stated object is furthermore achieved through the use of a layer heating module, comprising at least one substrate, in particular at least one carrier plate, and an electric heating coating applied to the substrate, in particular to the carrier plate, for the purposes of warming at least one fluid of a heat exchanger, in particular oil-water heat exchanger, preferably of the type described above.

Furthermore, the above-stated object is achieved independently by means of a method for producing a heat exchanger system, in particular oil-water heat exchanger system, preferably of the type described above, comprising the steps:

- providing or producing a heat exchanger module, in particular oil-water heat exchanger module, and a (separate) layer heating module, comprising a substrate, in particular a carrier plate, and an electric heating coating applied to the substrate, in particular to the carrier plate; and
- connecting heat exchanger module and layer heating module (in material-locking and/or non-positively locking and/or positively locking fashion), in particular by adhesive bonding and/or clamping.

The substrate, in particular the carrier plate, is preferably manufactured in dimensionally stable form or from a dimensionally stable material.

The above-stated object is furthermore achieved by means of a layer heating module for a heat exchanger, in particular oil-water heat exchanger, wherein the layer heating module has the features above and/or below.

Preferably, to produce the layer heating module, at least one hole is formed into the substrate, in particular the carrier plate. It is furthermore preferable for a contacting of the heating coating to be led through the at least one hole. In a specific embodiment, in a first sub-step a blind hole is produced in the substrate, in particular in the carrier plate, in a second sub-step (which follows the first sub-step) the heating coating is applied to the substrate, and in a third sub-step (which follows the second sub-step) a conductor section is guided against an end of the blind hole, preferably such that a base of the blind hole breaks, such that the conductor section comes into contact with the heating coating. Alternatively or in addition, two holes may be formed in the substrate. Preferably, a contacting for the heating coating is led through both holes and furthermore preferably extends (at least in sections) parallel to a plane defined by the heating coating (so as to make contact with the heating coating). Where features relating at least also to the production of the heat exchanger system are described further above (in conjunction with the heat exchanger system), these method features are also proposed as preferred embodiments of the method.

For control, in particular closed-loop control, of the electric heating coating, it is possible for a bimetal switch, possibly with two redundant switch devices, to be provided.

The heating coating may be applied indirectly, in particular with the interposition of an insulation layer, to the substrate, in particular to the carrier plate. An insulation layer of said type may be formed for example by an adhesion promoter layer. A polymer material may preferably be used for the insulation layer. The insulating layer is however preferably provided by a passivation, in particular an oxidization, in particular anodization (of aluminium or of an aluminium alloy). Altogether (specifically in low-voltage applications), a simple and nevertheless adequate electrical insulation is provided. Alternatively, the heating coating may be applied directly to the substrate, in particular to the carrier plate (for example in low-voltage applications and/or if the underlying surface is not electrically conductive or only poorly electrically conductive). Altogether, the complex construction in the prior art, comprising a heating layer, a cumbersome insulating layer and an adhesion promoter layer, can be reduced. The heating coating may basically be connected in material-locking fashion to a surface of the substrate, in particular to the carrier plate.

In one specific embodiment, the layer heating module is arranged on a heat exchanger cover of the (oil-water) heat exchanger module. Specifically in the case of a low-voltage application, even in the case of use on the outer side of the cover (which may be advantageous for example with regard to the contacting), adequately safe use of the (oil-water) heat exchanger module (even without a further protective element) is possible. Altogether, in this way, a simple and nevertheless reliably functioning structure is proposed.

In an alternative embodiment, the heating coating is formed as a continuous (in particular unstructured and/or uninterrupted) layer. The heating coating may generally have at least one section within which, in two mutually perpendicular directions, there are no interruptions in the heating coating over a distance of at least 1 cm, preferably at least 2 cm, even more preferably at least 4 cm. For example, the heating coating may comprise at least one rectangular section with a length and a width of in each case at least 1 cm, preferably at least 2 cm, even more preferably at least 4 cm, within which there are no interruptions or possible other structures in the heating coating. An "Interruption" within the heating coating is to be understood to mean a section through which no current can flow, for example because said section remains (entirely) free from material and/or is (at least partially) filled by an insulator. The heating coating may be thermally sprayed on (regardless of whether it is unstructured or structured in the final state). In this context, it has surprisingly been found that even a heating coating of such simple form can realize adequate warming of the oil.

In a further alternative embodiment, the heating coating is formed as a structured layer. The heating coating is in this case preferably structured by means of a masking process (preferably using silicone, which can be stamped). Such known masking processes permit satisfactory structuring and are less cumbersome than, for example, laser methods for structuring, which are used specifically in the high-voltage range. Altogether, therefore, the advantages of a masking process are utilized in a synergistic manner with regard to the present heating coating.

The above-described insulating layer may have a thickness of at least 50 μm, preferably at least 200 μm and/or at most 1000 μm, preferably at most 500 μm. The heating coating preferably has a height (thickness) of at least 5 μm, preferably at least 10 μm and/or at most 1 mm, preferably at most 500 μm, even more preferably at most 30 μm, even more preferably at most 20 μm. A conductor track defined by the heating coating may be at least 1 mm, preferably at least 3 mm, even more preferably at least 5 mm, even more preferably at least 10 mm, even more preferably at least 30 mm wide. The expression "width" is to be understood to mean the extent of the conductor track perpendicular to its longitudinal extent (which normally also defines the direction of the current flow).

In an alternative embodiment, a protective cover, for example a silicone protective layer, is applied over the heating coating. It is however alternatively also possible (in an embodiment which is particularly easy to produce) for the heating coating to define an outer side of the layer heating module.

In a specific embodiment, the oil-water heat exchanger module has multiple sub-units, in particular trough elements, which may furthermore preferably be designed as described in EP 2 466 241 A1. The oil-water heat exchanger module may basically (aside from the layer heating module according to the invention) be designed as described in EP 2 466 241 A1 or US 2015/0176913 A1. The disclosure of these documents is hereby expressly incorporated by reference. If multiple sub-units are provided, at least one layer heating module may possibly be arranged between two sub-units. If the oil-water heat exchanger module comprises multiple trough elements, at least one layer heating module may possibly be arranged (applied) between two of these trough elements (on one of the trough elements). In this way, the preheating (auxiliary heating) can be further improved using simple means.

The oil-water heat exchanger may have a turbulator. In such a case, the turbulator may be formed close to, for example no further than 5 cm from, in particular no further than 2 cm from, a heating coating, and/or equipped with a heating coating. This, too, is a further possibility for improving the warming of the fluid in a simple manner (specifically without the provision of further components). Here, in a synergistic manner, use is made of the fact that an increased heat transfer is possible in the region of a turbulator owing to the turbulence that is generated.

In general, the insulating layer may be a ceramic material or a polymer material or may be composed of such a material, wherein, as ceramic material, use is made for example of $Al_2O_3$.

The heating layer may be applied for example in a plasma coating process, in particular plasma spraying, or in a screenprinting process or as a resistance paste, in particular to the insulating layer. In the plasma coating process, it is for example firstly possible for an electrically conductive layer to be applied, in particular to the insulating layer. Regions may subsequently be cut out of the electrically conductive layer, such that a conductor track or multiple conductor tracks are left behind. Use is however preferably made of a masking technique. The conductor tracks may then form the heating resistor or multiple heating resistors. As an alternative to a masking technique, the stated regions may for example be cut out of the conductive layer by means of a laser. The heating coating may for example be a metal layer and possibly comprise nickel and/or chromium, or be composed of said materials. For example, use may be made of 70-90% nickel and 10-30% chromium, wherein a ratio of 80% nickel and 20% chromium is considered to be highly suitable.

The heating coating may for example cover an area of at least 5 $cm^2$, preferably at least 10 $cm^2$ and/or at most 200 $cm^2$, preferably at most 100 $cm^2$. The (oil-water) heat exchanger module or the (oil-water) heat exchanger system may have a total volume of preferably at least 200 $cm^3$, even more preferably at least 500 $cm^3$, even more preferably at least 800 $cm^3$ and/or at most 5000 $cm^3$, preferably at most 2000 $cm^3$. For example, the (oil-water) heat exchanger module or the (oil-water) heat exchanger system may be 15-25 cm long and/or 8-12 cm wide and/or 3-7 cm tall (thick).

The heat exchanger module, in particular oil-water heat exchanger module, preferably has one or more first fluid channels for conducting a first fluid, in particular the oil, and one or more second fluid channels for conducting a second fluid, in particular the water.

The invention will be described below on the basis of exemplary embodiments, which will be discussed in more detail on the basis of the figures. In the figures.

In the following description, the same reference signs will be used for identical parts and parts of identical action.

Figure 1:
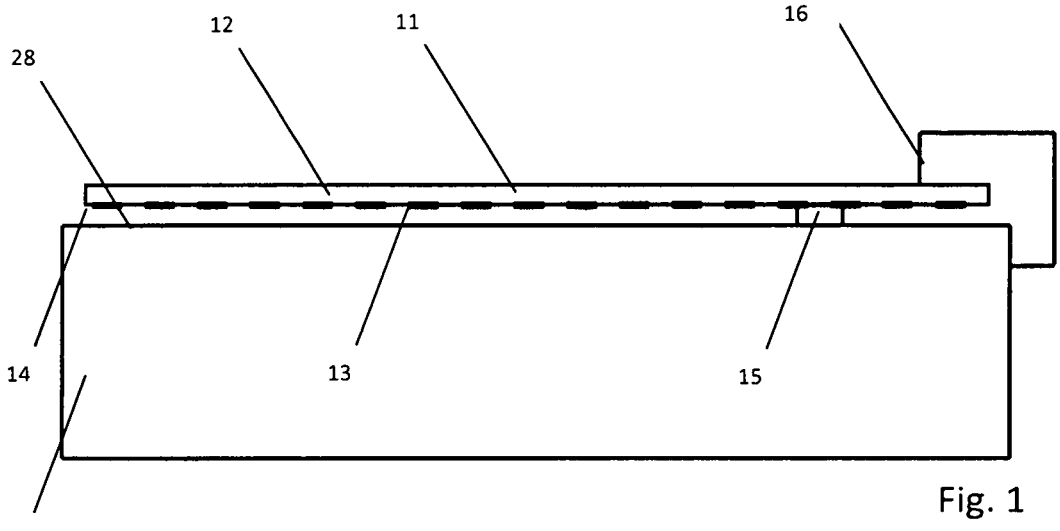
FIG. 1 shows a schematic view of a heat exchanger.

FIG. 1 shows an oil-water heat exchanger module 10 and a layer heating module 11. The oil-water heat exchanger module 10 may be constructed for example as described in EP 2 466 241 A1, in particular may have multiple (possibly soldered-together) trough elements.

The layer heating module 11 comprises a carrier plate 12 and an electric heating coating 13. The layer heating module 11 is preferably attached to a cover 28 of the oil-water heat exchanger 10.

The electric heating coating 13 is applied to a side 14 of the carrier plate 12 which faces toward the oil-water heat exchanger module 10 (though this is not imperative). The reference sign 15 indicates a first variant for the production of an earth contact, specifically by means of a pad 15 which connects the heating coating 13 to the oil-water heat exchanger module 10 (in particular a housing thereof). A further alternative is denoted by the reference sign 16, which specifically shows a line 16 which likewise connects the electric heating coating to the oil-water heat exchanger module 10 (in particular a housing thereof). Alternatively, the line 16 could also be earthed externally (that is to say not via the oil-water heat exchanger module 10). A contact corresponding to the earth contact is not illustrated. A second contact of said type could however likewise be formed by a line analogous to the line 16, if the latter is connected correspondingly (in a manner deviating from FIG. 1).

Figure 2:
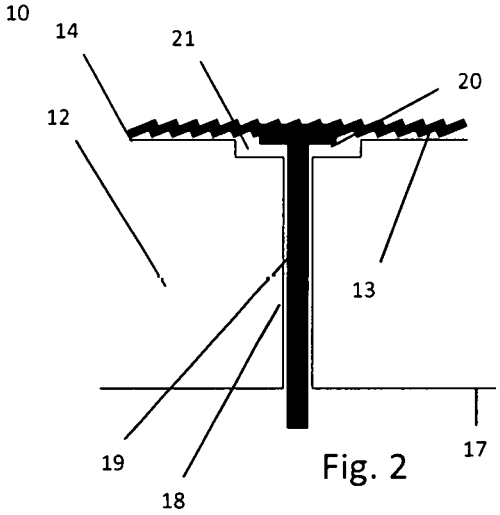
FIG. 2 shows a schematic detail of a layer heating module as per a first embodiment.

FIG. 2 shows a first embodiment of a contacting of the electric heating coating. In this case, too, the electric heating coating 13 is situated on a side 14 facing toward the carrier plate (not shown) (though this is not imperative). A side averted from the carrier plate is denoted by the reference sign 17. The carrier plate 12 has a hole 18 through which a conductor section 19 that forms the contacting is led. To facilitate the contacting, one end 20 of the conductor section 19 is formed as a widened portion and is arranged in or over a recess 21. The end 20 is then preferably oversprayed during the production of the heating coating 13, such that contact is formed.

Figure 3:
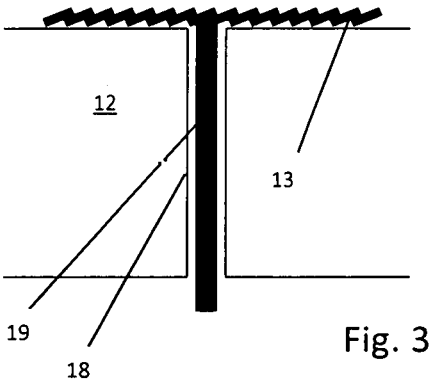
FIG. 3 shows a schematic detail of a further embodiment of the layer heating module.

FIG. 3 shows an embodiment similar to FIG. 2, in which, however, no widened end 20 and no recess 21 are provided.

Figure 4:
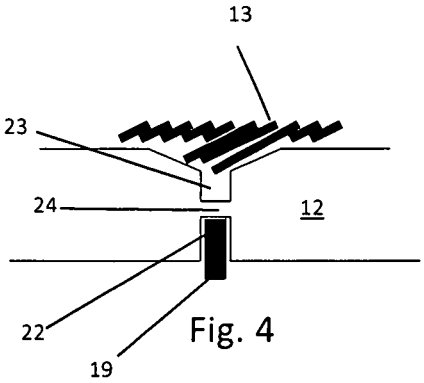
FIG. 4 shows a schematic detail of a (not yet fully produced) layer heating module as per a further embodiment.

FIG. 4 shows a schematic detail of the layer heating module prior to the final completion of production. Specifically, said figure shows a conductor section 19 which is being inserted into a blind hole 22. Opposite (or adjoining) the first blind hole 22, there is provided a second blind hole 23 (though this is not imperative). In a next step, the heating coating 13 is then applied, and thereafter a predetermined breaking point 24 between the two blind holes 22, 23 is broken through, such that the conductor section 19 can come into contact with the heating coating 13. The predetermined breaking point 24 is preferably defined by a web.

Figure 5:
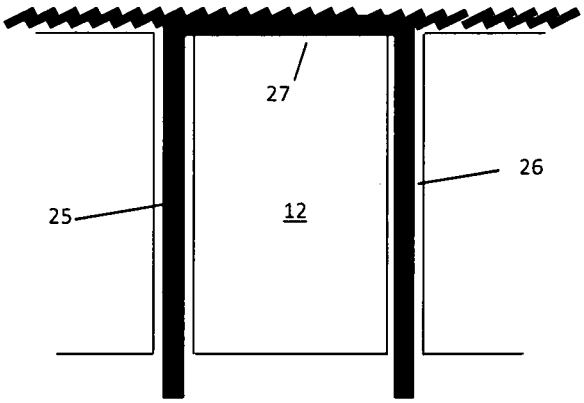
FIG. 5 shows a schematic detail of a further embodiment of the layer heating module.

FIG. 5 shows a further possibility of the contacting of the heating coating 13. In this embodiment, a first hole 25 and a second hole 26 are formed into the carrier plate 12. A conductor section 19 is in this case led both through the first hole 25 and through the second hole 26, such that a conductor subsection 27 runs parallel to the heating layer 13 so as to make contact therewith. Particularly simple and reliable contacting is realized in this way. Here, too, the electric heating coating is preferably applied (sprayed on) after the attachment of the conductor section 19.

It is pointed out at this juncture that all of the above-described parts both individually and in any combination, in particular the details illustrated in the drawings, are claimed as being essential to the invention. Modifications in relation to this are familiar to a person skilled in the art.

LIST OF REFERENCE SIGNS

10 Oil-water heat exchanger module
11 Layer heating module
12 Carrier plate
13 Electric heating coating
14 Side
15 Pad
16 Conductor
17 Side
18 Hole
19 Conductor section
20 End
21 Recess
22 First blind hole
23 Second blind hole
24 Predetermined breaking point
25 First hole
26 Second hole
27 Conductor subsection
28 Cover

The invention claimed is:

1. A heat exchanger system for connection to an internal combustion engine of a motor vehicle, comprising at least one heat exchanger module and a layer heating module, which is adhesively bonded and/or clamped to a cover of the heat exchanger module, wherein the layer heating module comprises a substrate formed as a carrier plate and an electric heating coating applied to the substrate.

2. The heat exchanger system according to claim 1, wherein the layer heating module is connected in material-locking fashion to the heat exchanger module.

3. The heat exchanger system according to claim 1, wherein the substrate is manufactured from an electrically and/or thermally insulating material.

4. The heat exchanger system according to claim 1, wherein the heating coating is arranged on that side of the substrate which faces towards the heat exchanger module.

5. The heat exchanger system according to claim 1, wherein, in the mounted state of the layer heating module, an intermediate space is formed between the layer heating module and the heat exchanger module, wherein the intermediate space is preferably filled with a filler material.

6. The heat exchanger system according to claim 1, wherein a contacting of the heating coating extends through the substrate wherein the contacting preferably extends at least twice through the substrate, such that one conductor section of the electrical conductor runs parallel to the electric heating coating so as to make contact therewith.

7. The heat exchanger system according to claim 1, wherein the electric heating coating is earthed via the heat exchanger module.

8. The heat exchanger system according to claim 1, wherein both sides of the substrate are provided with an electric heating coating.

9. The heat exchanger system according to claim 1, wherein at least two heat exchanger modules and/or at least two layer heating modules are provided, wherein at least one layer heating module is arranged between two heat exchanger modules.

10. The heat exchanger system according to claim 1, wherein the layer heating module is designed for operation in a low-volt range, the low voltage range being one of 12 volts, 24 volts or 48 volts.

11. Use of a layer heating module, comprising a substrate and an electric heating coating applied to the substrate for the purposes of warming at least one fluid of a heat exchanger.

12. A method for producing a heat exchanger system according to claim 1, comprising the steps:

providing or producing a heat exchanger module, and a layer heating module, comprising a substrate, and an electric heating coating applied to the substrate; and connecting the heat exchanger module and layer heating module by adhesive bonding and/or clamping.

13. Method according to claim 12, wherein, to produce the layer heating module, at least one hole is formed in the substrate, wherein a contacting for the contact of the electric heating coating is led through the at least one hole, wherein—in a first sub-step a blind hole is produced in the substrate, in a second sub-step the electric heating coating is applied to the substrate, and in a third sub-step a conductor section is guided against an end of the blind hole, such that a base of the blind hole breaks, such that the conductor section comes into contact with the electric heating coating, and/or wherein two holes are created in the substrate wherein a conductor section of the contacting runs parallel to the electric heating coating so as to make contact therewith.

14. The heat exchanger system according to claim 1, wherein the at least one heat exchanger module is an oil-water heat exchanger module.

15. The heat exchanger system according to claim 1, wherein the substrate comprises a carrier plate.

16. The heat exchanger system according to claim 2, wherein the layer heating module is adhesively bonded to the heat exchanger module.

17. The heat exchanger system according to claim 2, wherein the layer heating module is clamped in non-positively locking and/or positively locking fashion to the heat exchanger module.

18. The heat exchanger system according to claim 3, wherein the substrate is manufactured from ceramic.

19. The heat exchanger system according to claim 7, wherein the electric heating coating is earthed via a housing of the heat exchanger module.

20. The heat exchanger system according to claim 1, wherein the at least one heat exchanger module includes at least one first fluid channel for conducting a first fluid and at least one second fluid for conducting a second fluid.

* * * * *